United States Patent [19]

Nakanishi

[11] 4,050,252

[45] Sept. 27, 1977

[54] OCEAN NUCLEAR POWER EQUIPMENT

[75] Inventor: Tetsuichiro Nakanishi, Osaka, Japan

[73] Assignee: Hitachi Shipbuilding & Engineering Co., Ltd., Osaka, Japan

[21] Appl. No.: 651,892

[22] Filed: Jan. 23, 1976

[51] Int. Cl.[2] ..... F01K 23/04; F03G 7/04

[52] U.S. Cl. ..... 60/641; 60/644; 60/655

[58] Field of Search ..... 60/641, 644, 655, 690, 60/692, 643

[56] References Cited

U.S. PATENT DOCUMENTS

| | | | |
|---|---|---|---|
| 1,493,368 | 5/1924 | Merz | 60/641 |
| 1,952,520 | 3/1934 | Urquhart | 60/641 |
| 3,257,806 | 6/1966 | Stahl | 60/655 |
| 3,726,085 | 4/1973 | Arenson | 60/655 X |
| 3,820,334 | 6/1974 | Heller et al. | 60/692 X |
| 3,896,622 | 7/1975 | Daniello | 60/641 |

*Primary Examiner*—Allen M. Ostrager
*Attorney, Agent, or Firm*—Joseph W. Farley

[57] ABSTRACT

A temperature differential power plant is combined with a nuclear power plant and employs the temperature differential between hot water discharged from cooling the nuclear reactor, steam obtained from the nuclear reactor, and cold water taken in from an outside source such as the sea. The generated output and thermal efficiency of the entire power equipment is thereby increased; the temperature of the hot water discharged from cooling the nuclear reactor is decreased to aid in the recirculation thereof and eliminate hot water pollution; and, only the cold water taken in is discharged with its temperature being controllable so as not to create a cold water pollution problem. Temperature differential power plants can be used in stages with the hot water discharged from cooling the nuclear reactor passing successively from one stage to the next.

11 Claims, 6 Drawing Figures

OCEAN NUCLEAR POWER EQUIPMENT

The present invention relates to ocean nuclear power equipment and more particularly it relates to ocean nuclear power equipment consisting, in combination, of a nuclear power plant and a temperature differential power plant. The terms "ocean" and "sea" as used herein are intended to include any body of water from which coolant for the nuclear power equipment is obtained.

The problem connected with ocean nuclear power equipment is that the hot discharge water after cooling the nuclear reactor is discharged to the ocean, causing hot water pollution to the nearby sea areas. A principal object of the present invention is to make use of said hot discharge water after cooling the nuclear reactor together with steam obtained from the nuclear reactor as a heating medium for a working fluid in a temperature differential power plant so as to cool said hot discharge water, thereby eliminating the above described hot water pollution as well as efficiently increasing the generated output which can be obtained from the entire equipment.

Thus, ocean nuclear power equipment according to the present invention consists, in combination, of a nuclear power plant and a temperature differential power plant and is characterized in that said temperature differential power plant comprises electric power generating means which makes use of a temperature differential between the hot discharge water after cooling the nuclear reactor and steam obtained from the nuclear reactor, and cold water taken in from the sea.

With the nuclear power equipment of the present invention constructed in the manner described above, since the hot discharge water after cooling the nuclear reactor (together with steam from the nuclear reactor) is cooled as it is utilized as a heating medium for a working fluid in the temperature differential power plant, it is possible to pool it by water storage means for circulatory use for the cooling of the nuclear reactor without discharging it into the ocean. What is to be discharged from the entire equipment is the cold water or sea water which has been taken in from the sea and used for cooling and condensing the working fluid of the temperature differential power plant; and, although more or less elevated in temperature, this discharge water is still low enough in temperature (as compared with the hot discharge water after cooling the nuclear reactor) to substantially eliminate the danger of causing hot water pollution to the nearby sea areas. Moreover, since the steam obtained from the nuclear power plant (that is the steam after driving the steam turbine but before entering the condenser), and the hot discharge water after cooling the nuclear reactor are efficiently used as a heating medium for the working fluid in the temperature differential power plant to provide a separate generated output in addition to that from the nuclear power plant, the generated output from the entire nuclear power equipment can be efficiently increased.

Other numerous features and merits of the present invention will be readily understood from preferred embodiments of the invention to be described with reference to the accompanying drawings.

DESCRIPTION OF THE PREFERRED EMBODIMENTS

Figure 1:
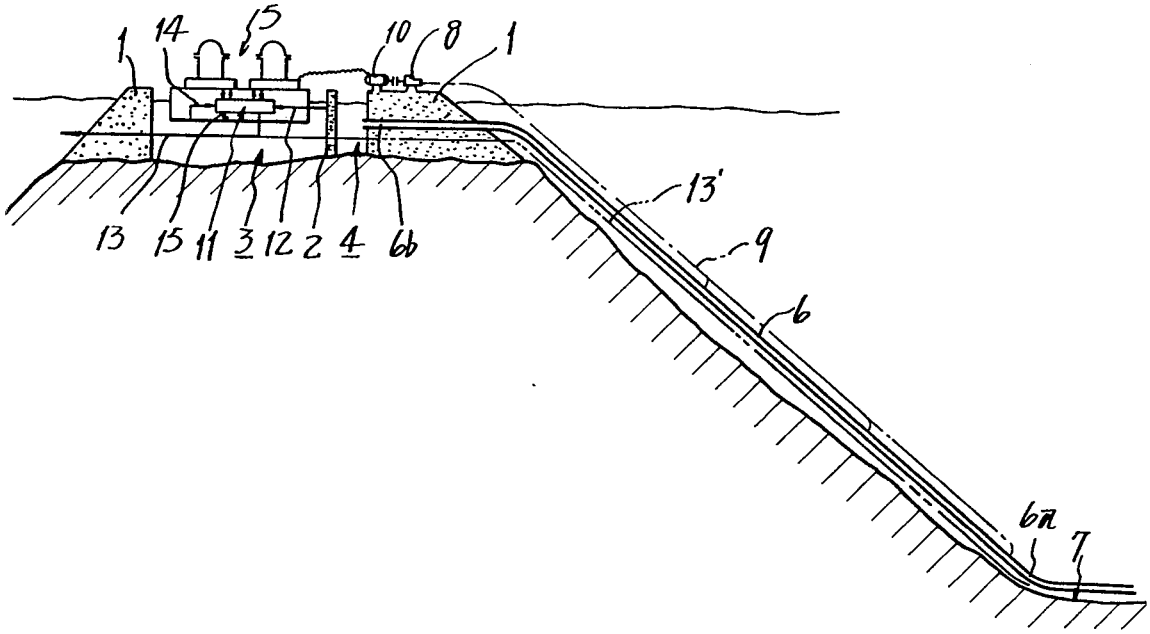
FIG. 1 is an entire schematic elevation showing a first embodiment of the present invention.

In FIG. 1, designated at 1 is an embankment constructed on a submarine mountain or reef rising above the sea floor, said embankment 1 being divided by a partition wall 2 to define a reservoir 3 into which nuclear reactor cooling water flows, and a second reservoir 4 into which sea water is taken from the depths of the sea. A nuclear plant 5 is floatably installed in said reservoir 3. Into said reservoir 4 opens the upper end *6b* of a submarine pipe 6 whose lower end *6a* opens to the deep sea floor 7. An air pipe 9 connected to a compressor 8 mounted on said embankment is installed to communicate with said submarine pipe at its lower end and at suitable intermediate places thereon. Thus, when air is fed into the submarine pipe 6 through the air pipe 9 by the compressor 8, rising air bubbles are produced in the submarine pipe 6 which act to push up the sea water within the pipe so that the sea water maintained at about 4° C in the depths of the sea is fed into the reservoir 4 by the principles of the so-called bubble pump. Designated at 10 is a driving motor for the compressor 8. The cold water in the reservoir 4 is fed through the pipe 12 into a temperature differential power plant 11 affixed to the nuclear power plant 5 and is finally discharged to the open sea outside the embankment 1 through a pipe 13. As for the hot discharge water in the reservoir 3, after being fed into the temperature differential power plant 11 through a pipe 14, it is fed back to the reservoir 3 through a pipe 15.

Figure 2:
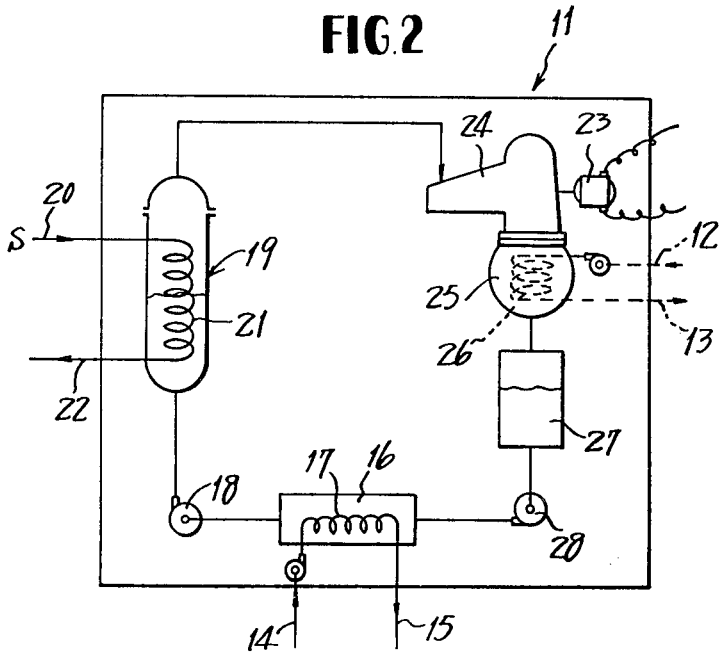
FIG. 2 is a view explanatory of the arrangement of a temperature differential power plant included in the first embodiment.

The temperature differential power plant 11 will now be described with reference to FIGS. 2 and 3. Working fluids to be used in the temperature differential power plant 11 include fluorine compounds (for example, Freon R-11 having a boiling point of about −4° C under atmospheric pressure) having boiling points suitably lower than that of water at the same pressure, or in some cases, ammonia may be used. Such working fluid is heated within a heating-purpose heat exchanger 16 in which it contacts a coil 17 through which the hot discharge water from said reservoir 3 flows. The working fluid thus heated is then fed into a steam generator 19 by a pump 18. All or part of the steam S from the steam turbine before entering the condenser in the nuclear power plant 5 is fed into the steam generator 19 through a pipe 20 and after passing through the coil 21 it is fed into the condenser through a pipe 22. Within the steam generator 19, the working fluid contacts the coil 21 and is thereby further heated to be converted into steam. The steam of the working fluid is fed into a turbine 24 connected to an electric generator 23, and drives the turbine to generate electric power. Thereafter, the working fluid flows into a condenser 25 where it is cooled as it contacts a coil 26 through which the cold water from the reservoir 4 flows, so that is is converted back into liquid which is then stored in a receiver tank 27, from which it is fed back to the heating-purpose heat exchanger 16 by a pump 28 for circulatory use.

According to the arrangement of this embodiment, since the discharge water from the nuclear power plant is limited to the water from the depths of the sea which has passed through the condenser 25, its temperature is low, having no danger of causing hot water pollution to the nearby sea areas. Moreover, the nuclear reactor cooling sea water in the reservoir 3 is used as a source of heating medium for the working fluid and thereby cooled, the head of heat being recovered as electric generating power. Further, since the steam from the nuclear reactor before entering the condenser is utilized as a source of heating medium for vaporization of the working fluid within the steam generator 19, the thermal efficiency of the entire nuclear power plant is also increased.

If there is the danger of cold water pollution being caused when the cold water from the depths of the sea which has passed through the condenser 25 is discharged to the nearby sea areas through the pipe 13, the pipe 13 may be extended to the depths of the sea to restore said cold water to the depths of the sea where it was taken in. Alternatively, before it is discharged, it may be mixed with hot water, e.g., part of the circulating water in the condenser in the nuclear power plant, or hot discharge water after cooling the nuclear reactor or hot discharge water passing through the heat exchanger 16 in the temperature differential power plant, so as to make its temperature approximately equal to that of the nearby sea water. In this manner, it is possible to prevent cold water pollution as well as hot water pollution.

In addition, it goes without saying that this ocean nuclear plant can also be applied where it is installed on the seashore adjacent to more than 300 meter deep sea. Further, it is desirable that the submarine pipe 6 be heat-insulation covered.

While a bubble pump has been used to pump up deep sea water into the reservoir 4, other general pumps may be used for this purpose.

Figure 3:
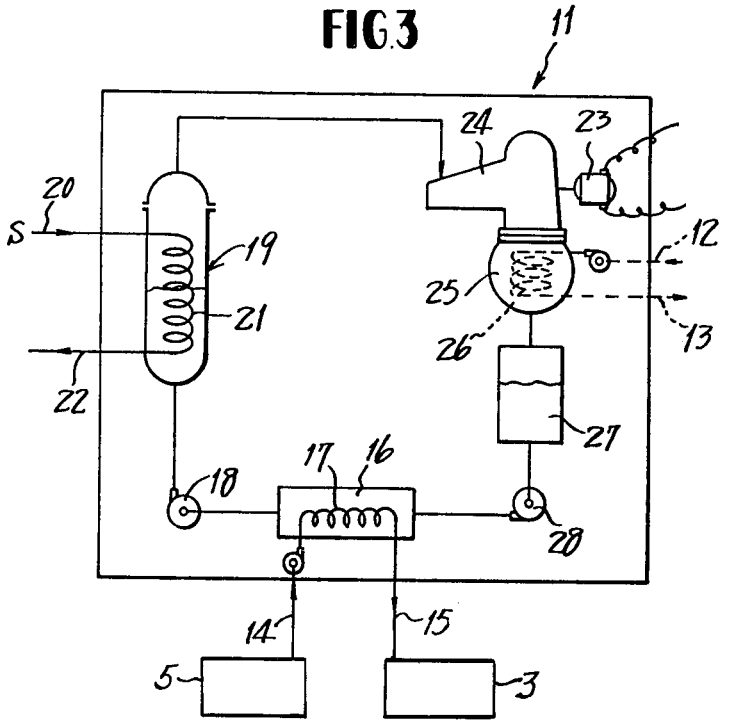
FIG. 3 is a view similar to FIG. 2 but showing an alternate arrangement for the hot water supply.

Further, as shown in FIG. 3, it is preferable in thermal efficiency to provide that the hot discharge water after cooling the nuclear reactor may be introduced wholly or partially into the heat exchanger 16 before it is led to the reservoir 3. Alternatively, as shown in FIG. 4, the reservoir 3 may be provided with a partition 36 which divides the reservoir into high and low temperature portions.

Figure 4:
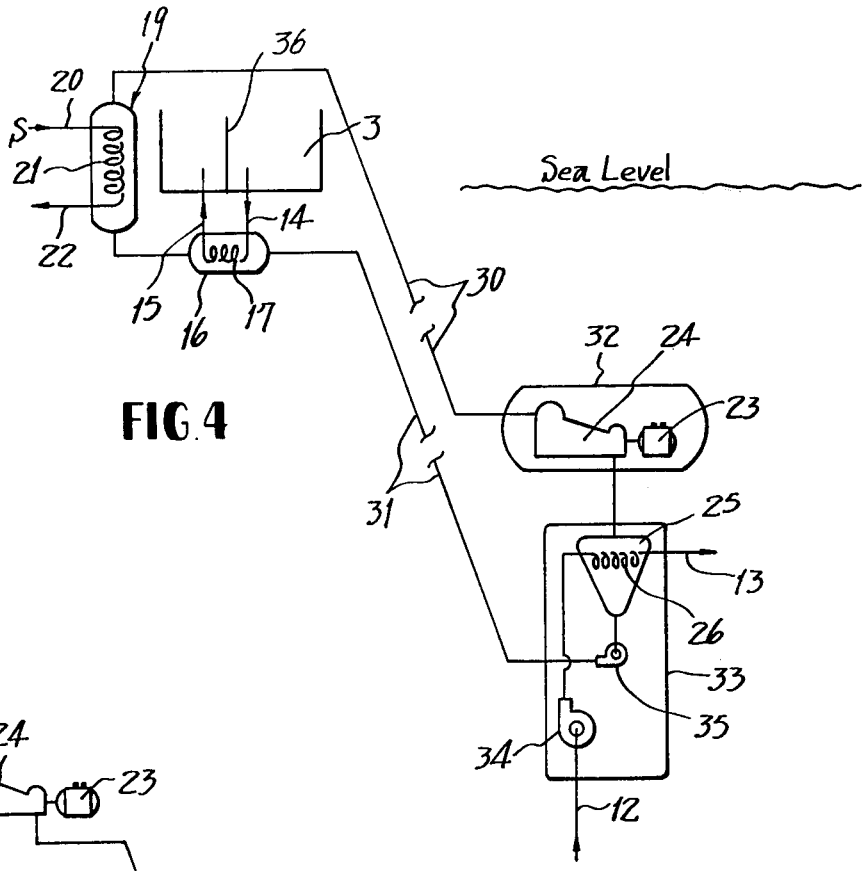
FIG. 4 is a view explanatory of the arrangement of a second embodiment of the invention.

FIG. 4 illustrates a second embodiment of the present invention. In this Figure, parts designated by the same reference characters as those used in FIGS. 1 and 2 are the same parts. In the second embodiment, the electric generator 23, turbine 24 and condenser 25 of the temperature differential power plant 11 are disposed beneath the surface of the sea to dispense with the pumping up of sea water (cold water) utilizing a long submarine pipe 6. However, since the heating-purpose heat exchanger 16 and steam generator 19 are affixed to the nuclear power plant 5, working fluid conduits 30 and 31 extending to the submarine turbine plant and condenser 25 are long pipes corresponding to the submarine pipe 6, it being desirable that the conduit 30 for introducing the vaporized working fluid from the steam generator 19 to the turbine 24 be covered with heat insulation. Designated at 32 is a hermetically sealed container for enclosing the turbine plant, and 33 designates a hermetically sealed container for enclosing the condenser 25, cold water circulating pump 34 and condensed working fluid feeding pump 35. In addition, since the pressure in the hermetically sealed container 32 becomes approximately as high as the gas pressure in the conduit 30 owing to the working fluid (in a gaseous state) leaking through the shaft of the turbine 24 and the like, the wall of said container may be relatively thin even if the water pressure acting on the container is taken into account. As considered from this point, the working fluid from the turbine 24 may be discharged into the hermetically sealed container 32, from which it may then be led to the condenser 25.

Instead of using two hermetically sealed containers 32 and 33, the entire submarine equipment including the turbine plant and condenser may be enclosed in a single hermetically sealed container.

Figure 5:
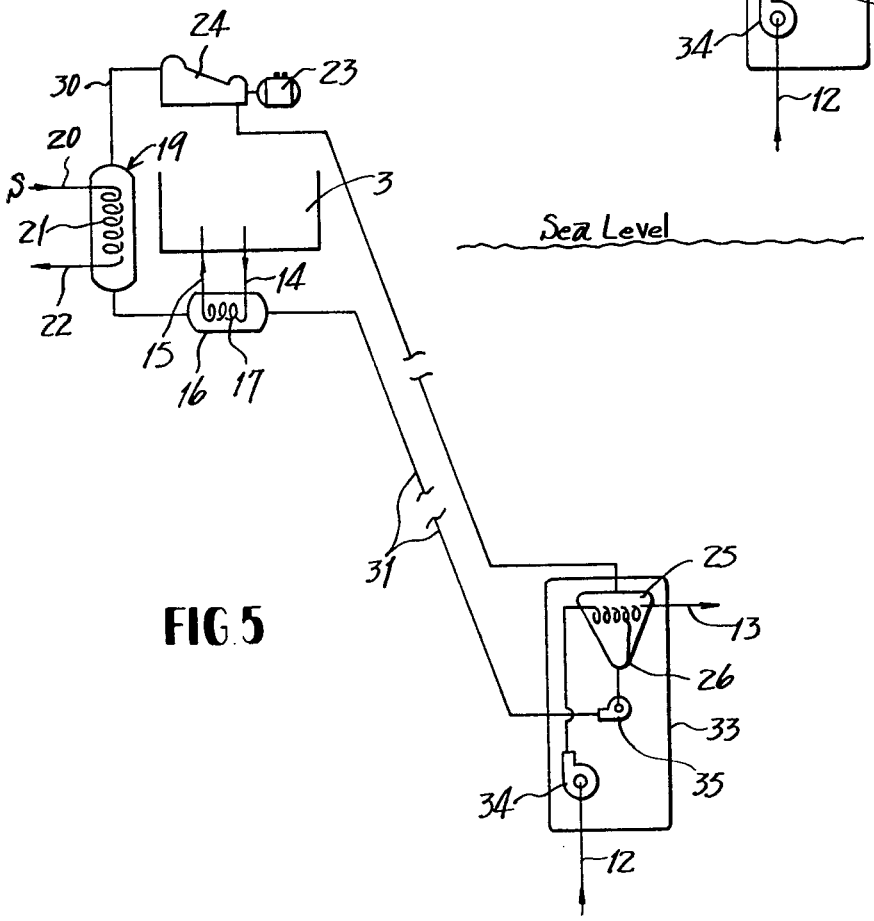
FIG. 5 is a view explanatory of the arrangement of a third embodiment of the invention.

FIG. 5 illustrates a third embodiment of the present invention, wherein the turbine plant including the turbine 24 and electric generator 23, together with the heating and vaporizing means 16, 19 for condensed working fluid is installed on the nuclear power plant 5. In this case, since the conduit 30 for vaporized working fluid does not pass through the sea, there is no need for large scale heat insulating means and the thermal efficiency is increased.

In the embodiments described above, the water pooled in the reservoir 3 is circulatorily used as nuclear reactor cooling water, but in this case, the water taken in from the reservoir 3 as nuclear reactor cooling water must be low temperature water as intended. However, in the case where only the use of the hot discharge water, after cooling the nuclear reactor, as a heating medium in the heat exchanger 16 of the single temperature differential power plant is not effective to lower the temperature of said discharge water to the intended value, the surface area of the reservoir 3 may be increased and/or any of the various means for positively effecting gas-and-water contact may be employed so as to elevate the cooling effect provided by heat exchange between air and the water stored in the reservoir 3; alternatively, the cold water discharged through said pipe 13 may be directly mixed or a heat exchanger using said cold water as a cooling medium may be employed so as to lower the temperature of the water stored in the reservoir 3. If the latter method is employed, the effect of cold water pollution being prevented can also be obtained as in the case described above.

Figure 6:
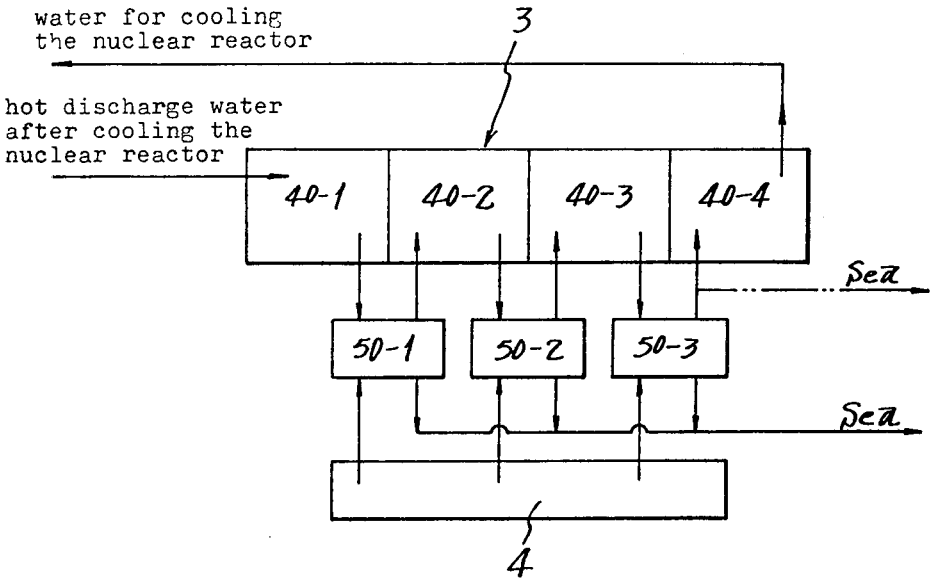
FIG. 6 is a view explanatory of the arrangement of a fourth embodiment of the invention.

FIG. 6 illustrates a fourth embodiment of the present invention, wherein the reservoir 3 directly encircling the electric power generating nuclear reactor is divided into a plurality of regions 40-1 to 40-4. There is provided a first temperature differential power plant 50-1 which generates electric power by the temperature differential between high temperature water obtained from the first region 40-1 where high temperature discharge water after cooling the nuclear reactor is stored, and low temperature water from the reservoir 4 where low temperature water taken in from the depths of the sea is stored. Hot discharge water which has passed through the first power plant 50-1 and whose temperature has been decreased by 2°–3° C is stored in the second region 40-2 and hot water obtained from this region and low temperature water obtained from the reservoir 4 are used to enable a second temperature differential power plant 50-2 to generate electric power. Similarly, hot water stored in the third region 50-3 and low temperature water from the reservoir 4 are used to enable a third temperature differential power plant 50-3, and so forth.

With such arrangement adopted, the provision of a required number of stages of temperature differential power plants enables the thermal energy of the high temperature discharge water after cooling the nuclear reactor to be effectively utilized to fully elevate the overall thermal efficiency, and since low temperature water which can be directly used as nuclear reactor cooling water can be stored in the final reservoir region 40-4, the nuclear reactor cooling water can be circulated in a completely closed circuit. Further, the discharge water used as the heating medium which has passed through the final temperature differential power plant 50-3 can be directly discharged to the nearby sea areas since it is possible to lower the temperature of said discharge water in advance to the extent of not causing hot water pollution.

In addition, as for a heating medium for each of the temperature differential power plants in the fourth embodiment, the steam which is obtained from the nuclear reactor and which has passed through the steam turbine may be additionally used, as described in the preceding embodiments.

I claim:

1. Ocean nuclear power equipment comprising a nuclear reactor power plant, a reservoir for storage of hot discharge water from cooling the nuclear reactor, the water pooled in said reservoir being circulatorily used as nuclear reactor cooling water, a source of cold water, a temperature differential power plant including electric generating means which makes use of a temperature differential between said hot discharge water and steam obtained from the nuclear reactor, and said cold water, means for conducting said hot discharge water through the temperature differential power plant to the reservoir whereby the temperature of said discharge water is lowered for recirculation to the nuclear reactor as said cooling water, and means for discharging said cold water from the temperature differential power plant.

2. Equipment as set forth in claim 1 further comprising a second reservoir for storing cold water taken in from said cold water source.

3. Equipment as set forth in claim 1 wherein said means for discharging said cold water is connected to said cold water source.

4. Equipment as set forth in claim 1, wherein said temperature differential power plant, together with the nuclear power plant, is installed on the sea and said cold water is raised from the deep sea through a submarine pipe and pump means.

5. Equipment as set forth in claim 4, wherein said pump means consists of a bubble pump for feeding pressurized air into said submarine pipe.

6. Equipment as set forth in claim 2, wherein a condenser for condensing a working fluid for said temperature differential power plant is disposed beneath the surface of the sea and cold water from the sea is fed into said condenser.

7. Equipment as set forth in claim 6, wherein the turbine plant of said temperature differential power plant including a turbine driven by vaporized working fluid and an electric generator driven by said turbine is affixed to the nuclear power plant on the sea together with the heating vaporizing means for the condensed working fluid.

8. Equipment as set forth in claim 6, wherein the turbine plant of said temperature differential power plant includes a turbine driven by vaporized working fluid, and an electric generator driven by said turbine is disposed beneath the surface of the sea together with said condenser while the heating vaporizing means for the condensed working fluid is affixed to the nuclear power plant on the sea.

9. Equipment as set forth in claim 8, wherein said turbine plant and said condenser are enclosed in separate hermetically sealed containers.

10. Equipment as set forth in claim 1, wherein the hot discharge water after cooling the nuclear reactor is successively utilized as a medium for heating a working fluid for a plurality of stages of temperature differential power plants.

11. Equipment as set forth in claim 10, wherein the discharge water after cooling the nuclear reactor, which has passed through the temperature differential power plant in the final stage is circulatorily used for cooling the nuclear reactor.

* * * * *